US011808035B2

(12) United States Patent
Preston

(10) Patent No.: US 11,808,035 B2
(45) Date of Patent: Nov. 7, 2023

(54) FACADE PANEL SYSTEM AND METHOD OF ERECTING A MULTI-STOREY STRUCTURE AND FACADE

(71) Applicant: John Clement Preston, Silverwater (AU)

(72) Inventor: John Clement Preston, Silverwater (AU)

( * ) Notice: Subject to any disclaimer, the term of this patent is extended or adjusted under 35 U.S.C. 154(b) by 0 days.

(21) Appl. No.: 17/266,345

(22) PCT Filed: Aug. 7, 2019

(86) PCT No.: PCT/AU2019/050826
§ 371 (c)(1),
(2) Date: Feb. 5, 2021

(87) PCT Pub. No.: WO2020/028948
PCT Pub. Date: Feb. 13, 2020

(65) Prior Publication Data

US 2021/0310241 A1 Oct. 7, 2021

(30) Foreign Application Priority Data

Aug. 7, 2018 (AU) ..... 2018902867
Sep. 25, 2018 (AU) ..... 2018903592
(Continued)

(51) Int. Cl.
*E04B 2/90* (2006.01)
*E01F 15/00* (2006.01)
(Continued)

(52) U.S. Cl.
CPC ..... *E04B 2/90* (2013.01); *E01F 15/003* (2013.01); *E01F 15/14* (2013.01); *E04B 1/61* (2013.01);
(Continued)

(58) Field of Classification Search
None
See application file for complete search history.

(56) References Cited

U.S. PATENT DOCUMENTS 4,108,322 A * 8/1978 Kochanneck ..... E04H 6/287 414/263
4,716,695 A * 1/1988 Alexander ..... E04B 1/164 52/696
(Continued)

FOREIGN PATENT DOCUMENTS

CN 1483105 A 3/2004
CN 1525020 A 9/2004
(Continued)

OTHER PUBLICATIONS

International Application No. PCT/AU2019/050825, International Search Report and Written Opinion, dated Oct. 25, 2019.
(Continued)

*Primary Examiner* — Joshua K Ihezie
(74) *Attorney, Agent, or Firm* — MARSHALL, GERSTEIN & BORUN LLP

(57) ABSTRACT

A facade assembly for a vehicle parking structure comprising a facade panel arranged to form part of an exterior of the structure. The facade assembly includes at least one support member extending inwardly of the panel and into the structure in use for connection with a floor of the structure. The support member is arranged to include one or more attachments.

18 Claims, 8 Drawing Sheets

(30) Foreign Application Priority Data

| | | |
|---|---|---|
| Sep. 25, 2018 | (AU) | 2018903595 |
| Sep. 25, 2018 | (AU) | 2018903596 |
| Nov. 26, 2018 | (AU) | 2018904498 |
| Nov. 26, 2018 | (AU) | 2018904499 |

(51) Int. Cl.

| | |
|---|---|
| ***E01F 15/14*** | (2006.01) |
| ***E04B 1/61*** | (2006.01) |
| ***E04H 6/08*** | (2006.01) |
| ***E04G 3/20*** | (2006.01) |
| ***E04G 21/32*** | (2006.01) |
| *E04B 5/10* | (2006.01) |

(52) U.S. Cl.

CPC ..... *E04G 3/20* (2013.01); *E04G 21/3247* (2013.01); *E04H 6/08* (2013.01); *E04B 5/10* (2013.01)

(56) References Cited

U.S. PATENT DOCUMENTS

| | | | | |
|---|---|---|---|---|
| 5,014,477 | A * | 5/1991 | MacDonald | E04B 2/967 52/204.593 |
| 5,158,392 | A * | 10/1992 | Takeda | E04B 2/34 52/235 |
| 5,826,381 | A | 10/1998 | Sasaki | |
| 6,301,848 | B1 | 10/2001 | Whitaker | |
| 7,644,549 | B2 * | 1/2010 | Speck | E04B 2/90 52/235 |
| 7,681,366 | B2 * | 3/2010 | De Gobbi | E04F 13/083 52/235 |
| 7,900,410 | B2 | 3/2011 | Skendzic et al. | |
| 8,359,797 | B2 * | 1/2013 | Lee | E04B 5/023 249/19 |
| 10,738,496 | B2 * | 8/2020 | Schmitt | B60L 53/31 |
| 2002/0146305 | A1 * | 10/2002 | Haag | E04H 6/225 414/807 |
| 2003/0033764 | A1 * | 2/2003 | Ting | E04B 2/96 52/235 |
| 2005/0095092 | A1 | 5/2005 | Segal et al. | |
| 2006/0016133 | A1 * | 1/2006 | Speck | E04B 2/90 52/79.1 |
| 2006/0228196 | A1 * | 10/2006 | Li | E04H 6/28 414/227 |
| 2007/0294952 | A1 * | 12/2007 | Li | E04H 6/285 52/30 |
| 2008/0222981 | A1 * | 9/2008 | De Gobbi | E04F 13/083 52/235 |
| 2010/0017016 | A1 * | 1/2010 | Zangerle | E04H 6/225 700/214 |
| 2010/0050547 | A1 * | 3/2010 | Speck | E04B 2/90 52/745.1 |
| 2010/0218443 | A1 * | 9/2010 | Studebaker | E04C 5/08 52/698 |
| 2010/0300021 | A1 * | 12/2010 | Falk | E04B 2/967 52/235 |
| 2017/0211287 | A1 * | 7/2017 | Schmitt | G06Q 10/02 |
| 2018/0119421 | A1 | 5/2018 | Pospisil et al. | |
| 2018/0230692 | A1 * | 8/2018 | Thebaud | E04H 1/04 |
| 2019/0093349 | A1 * | 3/2019 | LeVan | E04B 2/885 |
| 2021/0172169 | A1 * | 6/2021 | Toffoli | E04B 2/965 |
| 2021/0324642 | A1 * | 10/2021 | Preston | E04B 2/90 |
| 2021/0404181 | A1 * | 12/2021 | Naim Ibrahim | E06B 3/5409 |

FOREIGN PATENT DOCUMENTS

| | | | |
|---|---|---|---|
| CN | 1802477 | A | 7/2006 |
| CN | 101861438 | A | 10/2010 |
| CN | 105275087 | A | 1/2016 |
| CN | 206289794 | U | 6/2017 |
| CN | 206957312 | U | 2/2018 |
| CN | 107965185 | A | 4/2018 |
| DE | 102007058931 | A1 | 6/2009 |
| EP | 0422915 | A2 | 4/1991 |
| EP | 1394339 | A2 | 3/2004 |
| FR | 3058430 | A1 | 5/2018 |
| GB | 2061208 | A | 5/1981 |
| GB | 2433285 | A | 6/2007 |
| GB | 2502362 | A | 11/2013 |
| JP | 2005002714 | A | 1/2005 |
| JP | 3119660 | U | 3/2006 |
| KR | 100610311 | B1 | 8/2006 |
| KR | 10-2010-0017011 | A | 2/2010 |
| KR | 10-2013-0063522 | A | 6/2013 |
| KR | 20-2016-0002972 | U | 8/2016 |

OTHER PUBLICATIONS

International Application No. PCT/AU2019/050825, Written Opinion of the International Preliminary Examining Authority, dated Aug. 12, 2020.

International Application No. PCT/AU2019/050825, International Preliminary Report on Patentability, dated Nov. 10, 2020.

International Application No. PCT/AU2019/050826, International Search Report and Written Opinion, dated Oct. 21, 2019.

European Patent Application No. 19847654.1, Extended European Search Report, dated Mar. 21, 2022.

Chinese Patent Application No. 2019800648477, Office Action, dated Mar. 23, 2022.

* cited by examiner

FACADE PANEL SYSTEM AND METHOD OF ERECTING A MULTI-STOREY STRUCTURE AND FACADE

CROSS-REFERENCE TO RELATED APPLICATION

This application is a U.S. National Phase of International Patent Application No. PCT/AU2019/050826, filed Aug. 7, 2019, which claims priority under 35 USC § 119 to Australian Patent Application Nos. 2018904498, filed Nov. 26, 2018; 2018904499, filed Nov. 26, 2018; 2018903592, filed Sep. 25, 2018; 2018903595, filed on Sep. 25, 2018; 2018903596, filed Sep. 25, 2018; and 2018902867, filed Aug. 7, 2018.

TECHNICAL FIELD

This disclosure relates to multi-storey structures having an external facade. The disclosure has particular application to multi-storey parking structures and buildings having an external facade and is described in that context.

BACKGROUND ART

Multi-storey structures such as vehicle parking garages are known to utilise facade elements that are affixed to a multi-storey structure after erection of the structure. Known vehicle parking garages include wheel stops and crash barriers that are fixed to the floor or facade after erection of the structure. The fixing of the wheel stops, or crash barriers are typically drilled into floors that are concrete and fixed by mechanical fasteners. This arrangement may weaken the concrete and provide an entry point for moisture which can lead to corrosion of steel reinforcing and the bolting system, thereby making the structure susceptible to failure.

It is to be understood that, if any prior art is referred to herein, such reference does not constitute an admission that the prior art forms a part of the common general knowledge in the art in Australia or any other country.

SUMMARY

Disclosed is a facade assembly for a vehicle parking structure comprising a facade panel arranged to form part of an exterior of the structure. The facade assembly includes at least one support member extending inwardly of the panel and into the structure in use for connection with a floor of the structure. The support member is arranged to include one or more attachments.

The facade panels may be located around the perimeter of a ground level or an upper level of a structure. An advantage of the facade panel is its modularity. The facade panel is prefabricated including the at least one support member and arranged to include the one or more attachments. As a result, the facade panel in some embodiments already including the one or more attachments, is easily installed onto an existing structure. Further, the engagement of the one or more attachments to the at least one support member maintains the structural integrity of the at least one support member and the overall facade assembly.

In some embodiments, at least one of the one or more attachments is in the form of a wheel stop extending upwardly from the support member. In some embodiments, one of the attachments is in the form of a crash barrier extending upwardly from the support member. The attachment may be in any suitable form, for example, a parking meter or a sign and sign post for various function such as marking a parking spot, a speed bump, a speed limit or any kind of traffic/safety sign. In some forms, the facade assembly is prefabricated including the support member and the one or more attachments.

In some embodiments, the one or more attachments are fixed to the support by welding, mechanical fasteners, bolting, or in some forms may be encased in concrete. In some embodiments, the one or more attachments may be integrally formed with the support member.

In some embodiments, the facade panel is fixed or bolted to the structure. This allows for a panel to be removed and replaced if it is damaged, for example by a vehicle collision. The panel can be unbolted from the floor and removed. In some forms, the facade panels are located adjacent one another and/or above/below one another.

In some embodiments the at least one support member is fixed or bolted to the inner face of the panel. In some forms, the connection member is fixed or bolted to the support member. This allows for an assembly to be removed and replaced if it is damaged, for example by a vehicle collision. The panel can be unbolted from the at least one support member and removed.

In some embodiments, the facade assembly further comprises a connection member extending from the at least one support member. In some embodiments, the connection member comprises a hook or bar extending from the support member. In some embodiments, the connection member is bolted or removably fixed to the support member. In some embodiments, the connection members are arranged to connect the facade panel to the floor of the structure through encasing the connection members in concrete in use. The connection member may be encased in concrete before the facade panel is attached to the connection member or when the connection member is already attached to the facade assembly.

In some forms, the floor is cast in reinforced concrete the connection members are encased in the concrete of the upper floor. In some forms, the connection member comprises a hook or formed connection, and prior to encasing the connection member in concrete, the hook engages reinforcement bars of the reinforced concrete. In some forms, the connection member is fixed or bolted to the support member. This allows for a panel to be removed and replaced if it is damaged, for example by a vehicle collision. The panel can be unbolted from the floor and removed.

The connection member is configured to engage or connect with a floor of the multi-storey structure such that the facade is built in to the floor. This provides added strength to the facade and also allows the facade to provide fall prevention during building and also structural crash protection after the project is completed.

In some embodiments, the facade panel is fixed to at least one floor of the structure. The support member may be arranged to overlay the at least one floor of the structure. The support member may be arranged to project beyond an end of the floor of the structure. Further, the connection member may be integrally formed with, or connected to a distal end of the support member. In these embodiments, the connection member may be in the form of interlocking complementary arrangement, mechanical fasteners, welding, adhesive, or plates or any other suitable form.

In some embodiments, the facade panel further comprises a facade connection means located at the top or bottom edge of the facade panel. This may allow for the panel to be attached with a panel above or below to allow for further storeys of the structure to be built.

In some forms, the facade panels have a top edge and a bottom edge and in use the upper floor connection members are located intermediate the top edge and the bottom edge. This may have the benefit of extending the facade panel above a new floor once the floor is cast, meaning a worker or other person standing on the new floor is fenced in by the facade panel to provide some protection.

In some forms the facade panels are composed of a material sufficiently strong to withstand a vehicle colliding with the facade. This may have the benefit of providing a crash barrier for the multi-storey structure. Particularly in the case of vehicle parking structures, crash barriers are critical to prevent cars accidentally colliding with a wall of the building and plummeting through. The facade panel may be made of structural steel and engaged with the floor of the structure and therefore will prevent or limit the damage caused by colliding vehicles. This also allows an amount more space within the structure.

In some forms the facade panels prevent a person falling from the structure during and after building.

In some forms the at least one support member extends from the facade into the structure. In some forms the support member is positioned such that when construction is completed it is encased in the concrete of the floor.

In some forms the wheel stop includes a protrusion extending upwardly from the support member. The wheel stop allows for construction of a multi-storey car park without requiring wheel stops to be located on the floors of the car park. This reduces costs and labour.

In some forms the facade panel has opposing inner and outer faces, and in use top and bottom edges. In some forms the facade panel comprises a facade framework configured for support of an interior panel.

In some forms, the facade panel is composed of a material sufficiently strong to withstand a vehicle colliding with the facade. In some forms, the facade panels are composed of structural steel. In some forms, the facade panels include ventilation openings. In some forms, the facade panels are in the form of slatted, latticed or perforated steel. In some forms, the facade panels are decorative. For example, the facade panels may be in the form of steel slats. Facades for multi-storey structures such a vehicle parking stations generally are preferred to allow light and air in to reduce the need to extra lighting during the day and air conditioning. In some forms the facade panels are provide an aesthetic or are otherwise decorative allowing the multi-storey structure to have appeal. In some forms, the facade assembly further comprises at least one infill member arranged to be supported on the at least one support member and span between the at least one support member and an adjacent support member mounted to the structure.

Also disclosed is modular facade system for a vehicle parking structure comprising a plurality of facade assemblies according to any preceding claim, wherein the facade assemblies are arranged in side by side arrangement to form at least part of the external facade of the structure, the respective support members of the assemblies extending inwardly of the external facade and being connected to one or more floors of the structure.

In some embodiments, the vehicle parking structure is multi storey and the facade assemblies are arranged to be disposed both side by side and one on top of another to form at least part of the external facade of the multi-storey parking structure.

Also disclosed is a vehicle parking structure comprising one or more floors and an exterior facade formed at least in part by the modular facade system disclosed above.

Also disclosed is a method of erecting a vehicle parking structure comprising at least one floor, the method comprising using the modular facade system disclosed above, to form at least part of the external facade with the support members being connected to the at least one floor.

In some embodiments, the modular facade system is installed after forming the one or more floors of the structure.

In some embodiments, the modular facade system is erected before forming the more or more floors of the structure.

BRIEF DESCRIPTION OF THE DRAWINGS

Embodiments will now be described by way of example only, with reference to the accompanying drawings in which.

DETAILED DESCRIPTION

Figure 1:
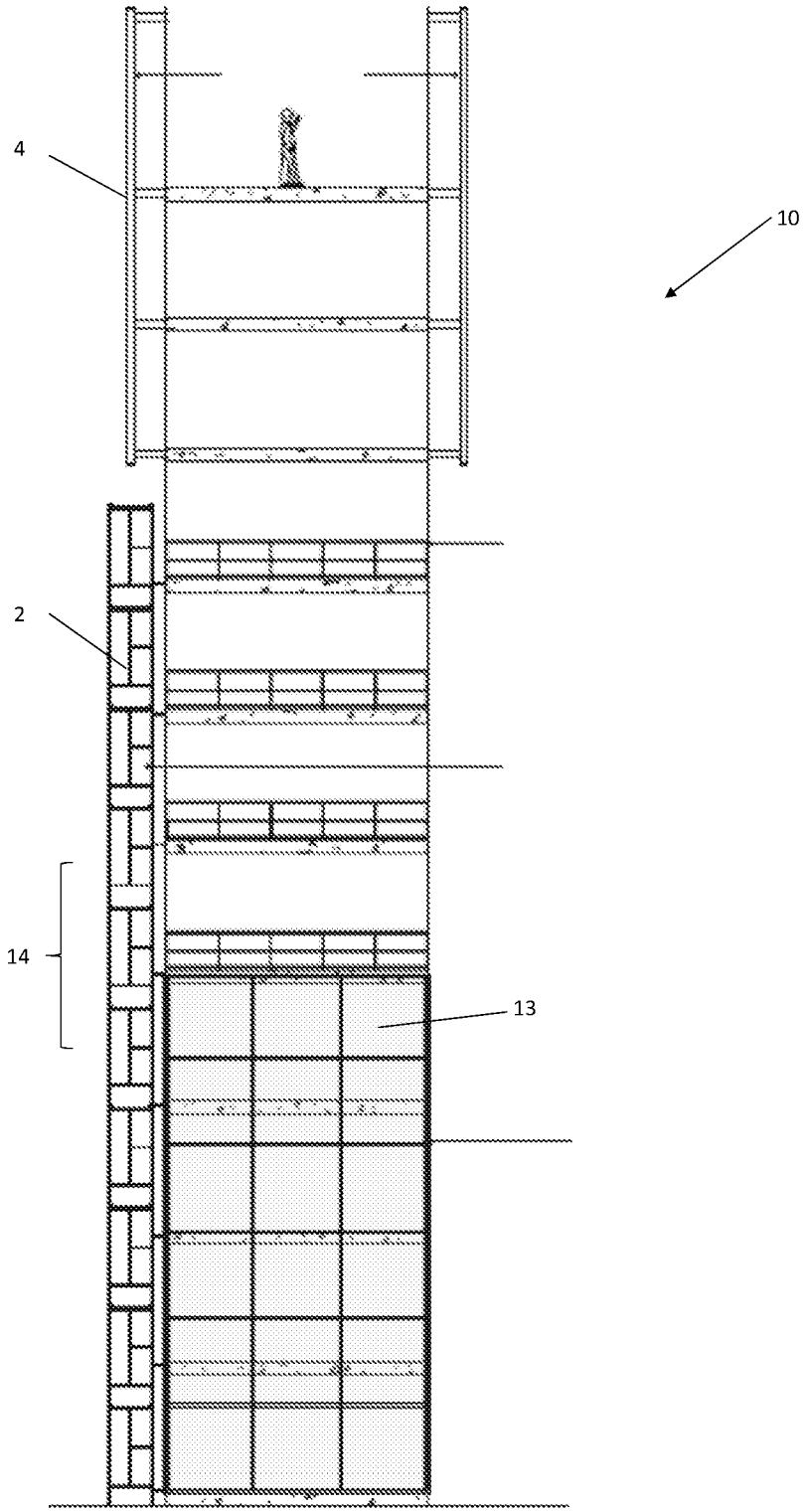
FIG. 1 is a cross-sectional view of an embodiment of a multi-storey structure under construction.

In the following detailed description, reference is made to accompanying drawings which form a part of the detailed description. The illustrative embodiments described in the detailed description, depicted in the drawings and defined in the claims, are not intended to be limiting. Other embodiments may be utilised and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

Referring now to FIG. 1, disclosed is a multi-storey building 10 such as a vehicle parking structure, the structure having a facade. Construction of the structure 10 is normally completed through erecting a scaffolding 2 and/or a perimeter screen 4; building the internal portion of the structure up floor by floor; and fixing facade panels 12 to the internal portion of the structure 12. The multi-storey structure 10 comprises a plurality of facade assemblies 12 forming an outer facade 13 of the multi-storey structure. The floors 14 of the multi-storey structure are contained within the facade 13.

Figure 2:
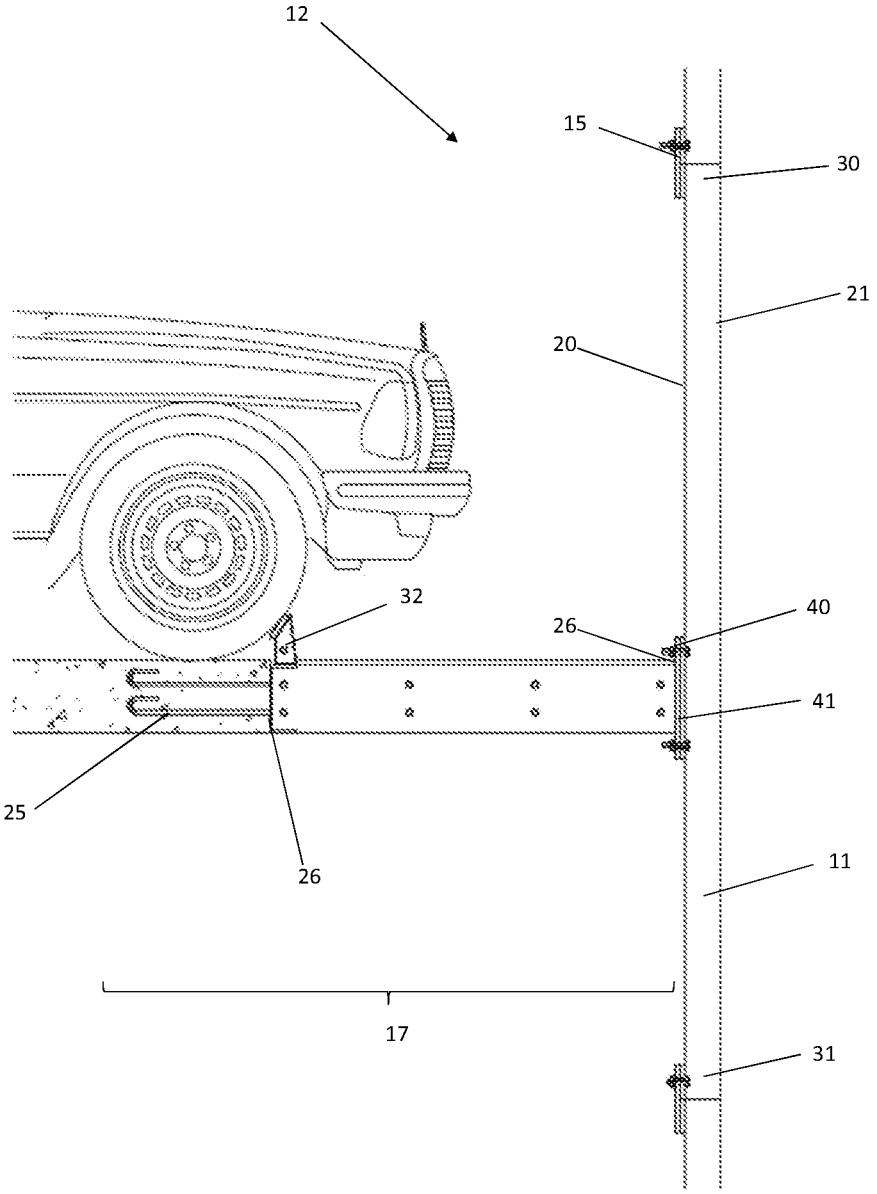
FIG. 2 is a cross sectional view of an embodiment of a facade assembly including a support member mounted to the multi-storey structure of FIG. 1.
Figure 3:
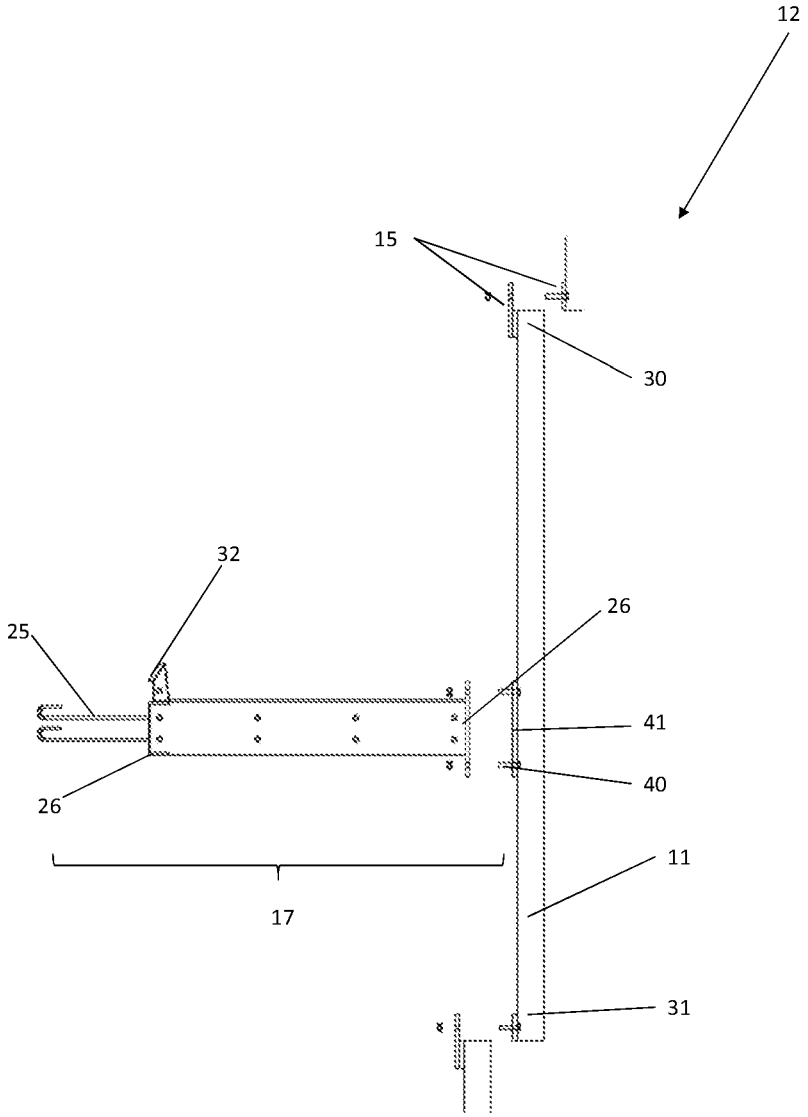
FIG. 3 is a cross-sectional exploded view of the multi-storey structure of FIG. 2, further through the construction process.

Now referring to FIGS. 2 and 3, each facade panel 11 includes opposing inner and outer faces 20, 21. Each panel also includes in use top and bottom edges 30, 31. The facade assemblies 12 include a panel engagement section 15 which is configured to allow the facade panel 11 to be engaged with a facade panel above or below within the outer facade 13 and is positioned at the inward face and the top and bottom edges 30, 31 of the panels.

The facade assemblies 12 further include at least one support member 17 which is adapted to connect or engage a floor 14 with the facade panel 12. The support member 17 is located to extend inwardly from the interior face 20 of the facade panels 11 and a floor connection plate 26 extends from the at least one support member 17 at either end.

In the illustrated embodiment, the at least one support member 17 is located intermediate the top edge 30 and bottom edge 31 of the facade panels 11. In alternative embodiments, the support member 17 may be located proximal to or at the top and bottom edges 30, 31 of the panels 12.

The at least one support member 17 includes one or more attachments. In the illustrated embodiment, the at least one support member 17 is in the form of one support member and the attachment is in the form of a wheel stop 32. The wheel stop 32 extends upwardly in use from the support member 17 to contact the wheels of a vehicle when it is being parked. The wheel stop 32 is designed to be low profile so it does not damage the underside or from of a vehicle. The wheel stop 32 may be attached to the support member by any means, such as bolts, plates, welding or any suitable means. The wheel stop 32 may also be integrally formed with the support member 17. The wheel stop 32 provides impact resistance to protect the facade panels 11 from being damaged when cars are being parked. It is understood that the wheel stop 32 will be repeatedly impacted by cars and must be able to withstand the impact. A benefit of the disclosed wheel stop 32 is that it is attached to the facade assembly 12 rather than being drilled into the concrete. The weakness created in the concrete through drilling is all together avoided in the present disclosure. As a result, the wheel stop 32 and the facade panel together have structural integrity and a longer life span requiring less replacement.

Each floor is typically constructed by laying a system of formwork, and a system of reinforcing bars. Concrete is then poured into the formwork to embed the reinforcing bars. The support member 17 may also comprise a connection member 25 in the form of a hook. In the illustrated embodiment, the hook is encased in concrete. The hook 25 may also interconnected with the system of reinforcing bars laid to support the concrete. The connection members 25 extends from one of the connection plates 26 and may be welded, bolted or otherwise engaged with the connection plate 26. The connection plates 26 (one may be located at either end of the support member 17) may be engaged with the support member 17 by means of bolts, welding, a plate or any other means. Alternative connection means are available or in some non-illustrated forms the connection member 25 may be integral with or welded to the panel 11. In further alternative embodiments, the connection member to connect the support member to the floor may simply be another connection means such as plates and bolts, welding or any other means. Further, the connection member may be embedded into the concrete and then removably fixed to the support member of the facade assembly.

Figure 4:
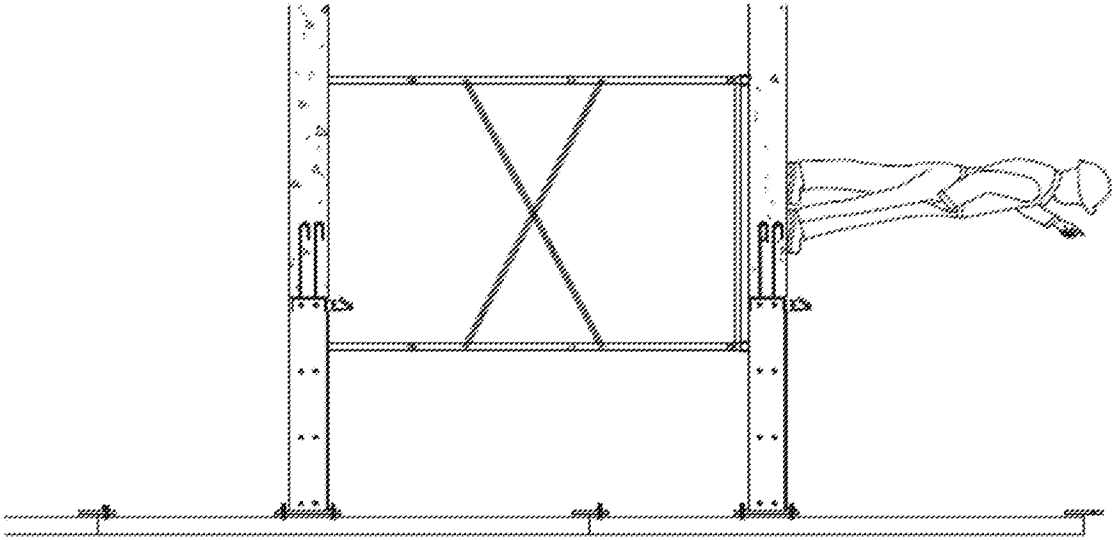
FIG. 4 is a cross-sectional view of the multi-storey structure of FIG. 2 during construction.

Also shown in FIGS. 3 and 4 is a connection 15 between a facade panel 11 and an adjacent upper or lower facade panel 11 is shown. The connection may be bolted 40 and may include a plurality of plates 41 as shown in the figure or may be welded or otherwise connected. In alternative embodiments alternative attachment means may be used.

Figure 5:
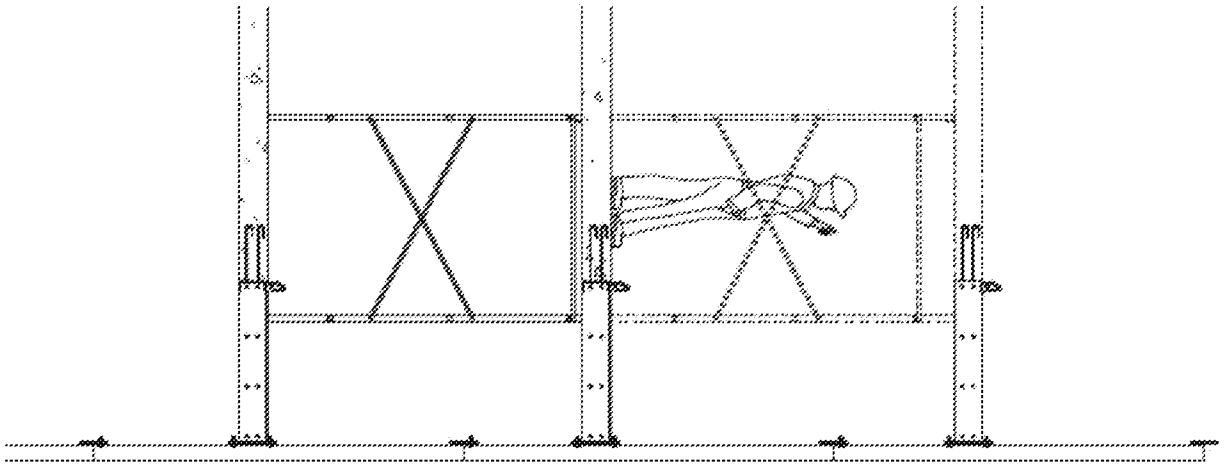
FIG. 5 is a cross-sectional view of the multi-storey structure of FIG. 4, further through the construction process.

FIGS. 4 and 5 illustrate a worker standing on one of the floors interior the structure and the facade panels 12 are mounted to the structure. The scaffolding or perimeter screen is not shown in these Figures.

Figure 6:
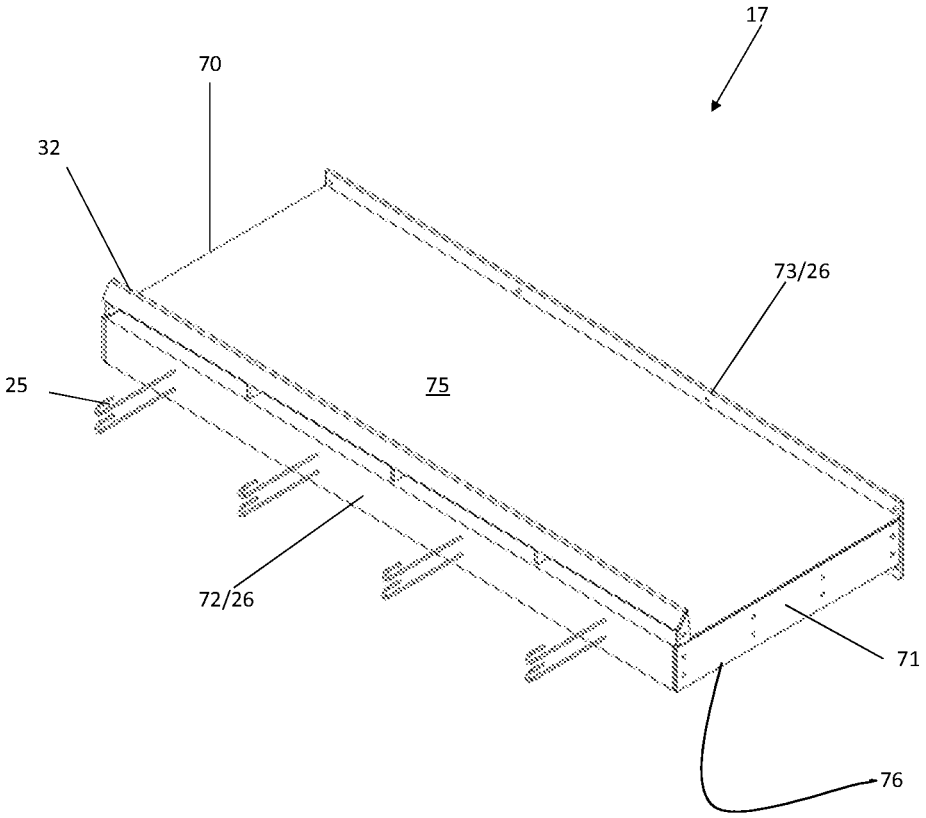
FIG. 6 is an isometric view of the facade assembly of the second embodiment of the disclosure.

Now referring to FIG. 6, the support member 17 is shown on separate from the facade assembly 12. In general, the support member extends between two opposing ends 70, 71, and two opposing sides 72, 73. The connection members 25 extending outwardly from one of the sides 72. The plates 26 form the opposing sides. The support member 17 also includes top 75 and bottom 76 members that are generally rectangular and formed as one member. However, the support member 17 may be formed from slats that extend between the sides or the ends or a combination of both. The slats may be included between the top and bottom members, or without the top and bottom members. The slats may act as stiffening ribs designed to hold the shape of the support member 17. When the support member 17 is at least partially hollow, it may be filled with concrete when the floor is filled with concrete to integrate the facade assembly 12 into the floor and the structure. In non-illustrated alternative embodiments, the support member may also include or be formed of mesh, latticed or perforated steel to allow drainage or for any decorative purpose. In this way, any of the members used to form the support member may be formed of mesh, latticed or perforated steel.

The support member 17 may formed from steel or any other material sufficiently strong to support the facade panels 12 being mounted to the floors 14 of the structure 10.

Figure 7:
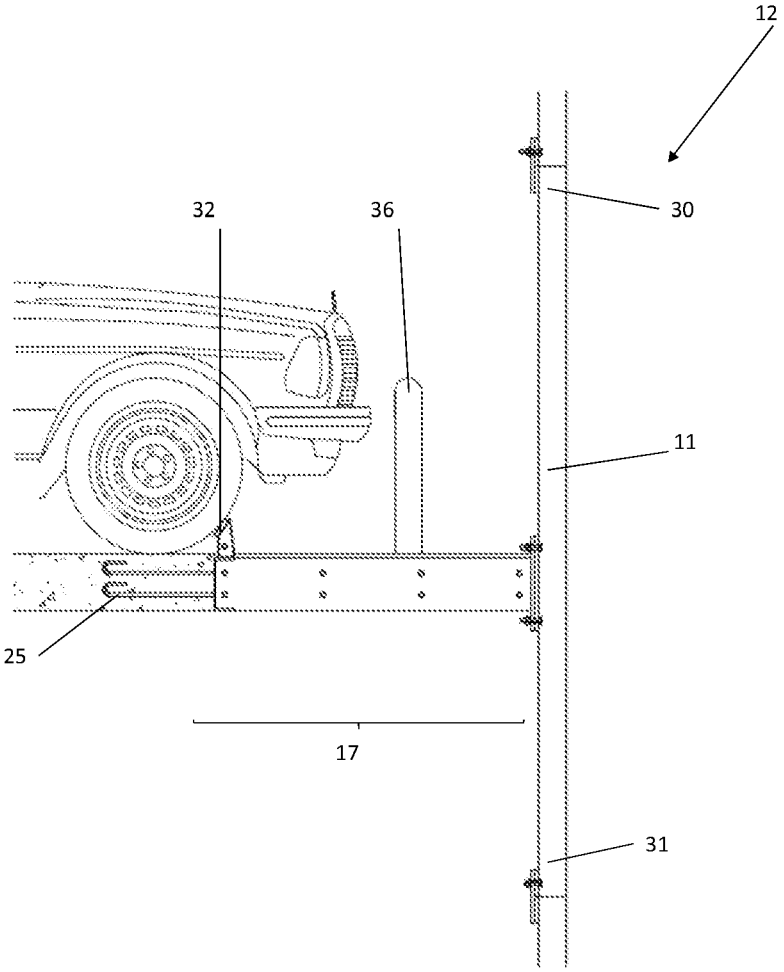
FIG. 7 is a cross sectional view of a further embodiment of a facade assembly including a support member of the disclosure in use.
Figure 8:
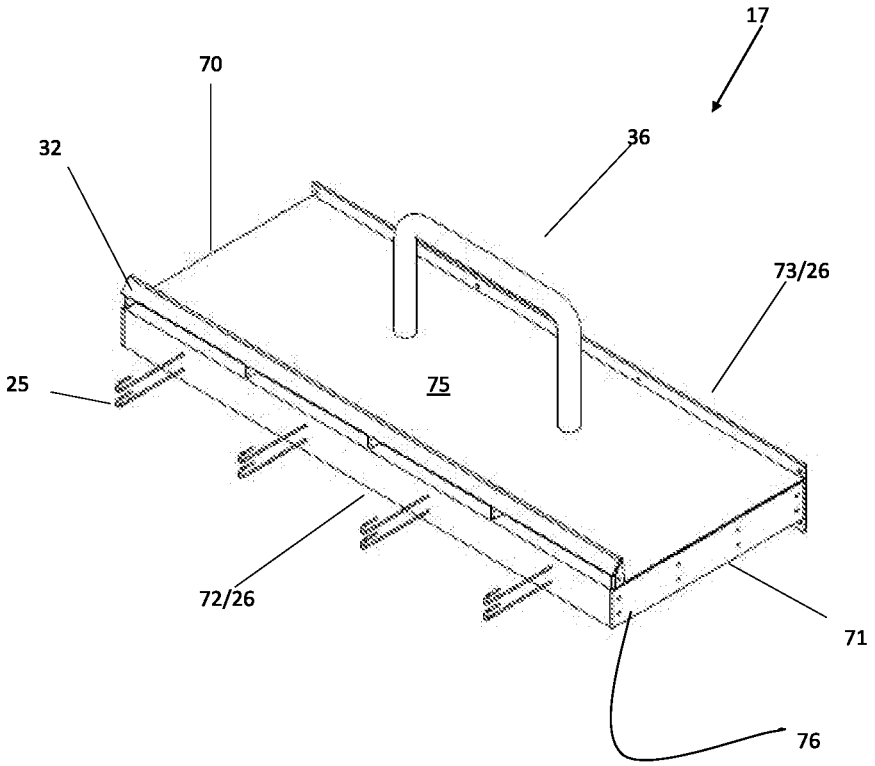
FIG. 8 is an isometric view of the facade assembly of FIG. 7.

A further embodiment of a facade assembly 12 is shown in FIGS. 7 and 8. Like reference numerals are used for like features. The primary difference between the first embodiment and the second embodiment of the facade assembly is that a further attachment is illustrated in the second embodiment. In particular, the facade panel 11 further includes an attachment in the form of a crash barrier 36 which is engaged with the support member 17. The crash barrier 36 may be built-in. The crash barrier 36 may be engaged with the facade assembly 12 by means of welding, bolting or any other construction means. The crash barrier 36 and facade panel 11 are sufficiently strong to withstand a collision by a vehicle. In alternative embodiments, the crash barrier may extend inwardly from the facade panel. The facade assembly 12 disclosed has the benefit of allowing the parking structure to be built without requiring additional fall protection or a crash barrier.

In general, the facade panel 11 may be in any form. In some forms, the facade panel comprises slats extending vertically up the facade panel with spaces in between the slats to allow ventilation and light flow. The facade panels may further include cross-beams providing support to the facade panels. The panels may further include upper and lower webs for further support. In some forms the cross-beams and upper and lower webs are on the inside such that the external face of the panels is aesthetically pleasing.

Further, the facade assemblies have the benefit of extending the perimeter of the structure and may include three dimensional features such as garden walls or outer ledges. This is the result of the facade assembly themselves including three dimensions. Further, the facade assembly may include structural feature extending outwardly from the facade panels. The outwardly extending structural features may act as the fall protection barrier during construction.

In alternative embodiments, the construction process may include the facade being positioned before the upper floors are built. This allows the facade to act as a fall prevention screen. Once the project is completed the facade remains as a decorative outer screen. In some forms the facade may be sufficiently strong to act as a crash barrier and prevent vehicles driving off the structure. The combination of built in attachments such as wheel stop and crash barrier equivalent greatly reduces the construction required while also enhancing the structural integrity of the structure and facade panels.

In alternative non-illustrated embodiments, the facade panels may be formed with various aesthetic external appearances such as profiled sheets, perforated sheets, composite, garden wall, or glass. The external facade may be in variant surfaces, materials and colours. Multiple variant external facades are available.

In some not-illustrated forms, the panels of the disclosure may comprise panel frames that act as part of the building's permanent facade with infill material that may be replaced. For example, frames may include a removable infill panel which can be replaced with glass or other material. In other forms, the panels may comprise frames and wall material that will act as the permanent facade of the building along with an interior protective material that can be removed once construction is performed. For example, the panels could comprise a glass exterior and a board or polymer interior removable material.

In some forms, the panels of the disclosure may form one part of the building facade. For example in some forms the panels of the disclosure may comprise a framework or a facade region to support a window, door, or facade panel.

In some forms, the facade assembly for a vehicle parking structure may comprise a facade panel having opposing inner and outer faces, and in use top and bottom edges, the facade panel being arranged to form part of an exterior of the structure; at least one support member extending inwardly of the panel and into the structure in use for connection with a floor of the structure. The support member may include connectors for adding attachments to the support member. The support member may be removably engageable with the facade panel. The engagement may utilise a support plate that engages the facade panel. The support member may include a connection member for connection with a floor of the structure. The connection member may be arranged to be cast into the at least one floor of the structure. The facade panel may be composed of material(s) sufficiently strong to withstand a vehicle colliding with the facade, for example structural steel. The facade panels may include ventilation openings. The facade panel may be in the form of slatted, latticed or perforated steel.

Variations and modifications may be made to the parts previously described without departing from the spirit or ambit of the disclosure.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A fixed vehicle parking structure facade assembly for a vehicle parking structure, the vehicle parking structure comprising at least one floor for parked vehicles, the fixed vehicle parking structure façade assembly comprising:

a facade panel arranged to form part of an exterior of the vehicle parking structure;

at least one support member extending inwardly of the panel, the support member configured in use for connection with the at least one floor of the structure and when so connected, to project from the floor;

at least one connection member configured to interconnect the at least one support member to the floor; and one or more attachments suitable for a vehicle parking structure, the one or more attachment comprising at least one of a wheel stop or crash barrier secured to and extending upwardly from the support member.

2. A fixed vehicle parking structure facade assembly as defined in claim 1, wherein each of the one or more attachments is integrally formed with the support member or fixed to the support member.

3. A fixed vehicle parking structure facade assembly as defined in claim 1, wherein the facade panel assembly is fixed to at the least one floor of the structure.

4. A fixed vehicle parking structure facade assembly as defined in claim 3, wherein the support member is arranged to project beyond an end of the floor of the structure.

5. A fixed vehicle parking structure facade assembly as defined in claim 4, wherein the at least one connection member is integrally formed with, or connected to, a distal end of the support member.

6. A fixed vehicle parking structure facade assembly as defined in claim 5, wherein the at least one connection member is arranged to be cast into the at least one floor of the structure.

7. A fixed vehicle parking structure facade assembly as defined in claim 5, wherein the at least one connection member is bolted or removably fixed to the support member.

8. A fixed vehicle parking structure facade assembly as defined in claim 1, the facade panel comprising a facade framework configured for support of an interior panel.

9. A fixed vehicle parking structure facade assembly as defined in claim 1, further comprising a facade connection means located at a top and/or a bottom edge of the facade panel to connect the panel to a like facade panel.

10. A fixed vehicle parking structure facade assembly as defined in claim 1, wherein the facade panel is composed of material(s) sufficiently strong to withstand a vehicle colliding with the facade.

11. The fixed vehicle parking structure facade assembly as defined in claim 1, further comprising at least one infill member arranged to be supported on the at least one support member and span between the at least one support member and an adjacent support member mounted to the structure.

12. A fixed modular vehicle parking structure facade system for a parking structure, the parking structure comprising at least one floor for parked vehicles, the fixed modular vehicle parking structure façade system comprising a plurality of vehicle parking structure facade assemblies, each façade assembly comprising a façade panel arranged to form part of an exterior of the vehicle parking structure; and at least one support member extending inwardly of the panel, the support member configured in use for connection with the at least one floor of the structure, and when so connected, to project from the floor, at least one connection member to interconnect the at least one support member to the floor; and one or more attachments suitable for a vehicle parking structure, the one or more attachment comprising at least one of a wheel stop or crash barrier secured to and extending upwardly from the support member, wherein the facade assemblies are arranged in side by side arrangement with the respective support members of the façade assemblies extending inwardly of the external facade and being connected to the at least one floor of the vehicle parking structure.

13. A fixed modular vehicle parking structure facade system as defined in claim 12, wherein the vehicle parking structure is multi storey and the facade assemblies are arranged to be disposed in both side by side and one on top of another to form at least part of the external facade of the multi-storey parking structure.

14. A method of erecting a fixed vehicle parking structure comprising at least one floor, the method comprising using a modular facade system to form at least part of the external façade, the modular façade system comprising a plurality of façade assemblies, each façade assembly comprising a façade panel arranged to form part of an exterior of the structure; and at least one support member extending inwardly of the panel and into the structure; connecting the support member with a floor of the structure; and disposing one or more attachments suitable for a vehicle parking structure, the one or more attachment comprising at least one of a wheel stop or crash barrier on the support members.

15. A method as defined in claim 14, wherein the modular facade system is erected before forming the one or more floors of the structure.

16. A method as defined in claim 15, wherein one or more attachments is preinstalled on the support member.

17. A fixed vehicle parking structure; comprising at least one floor for supporting vehicles thereon;

a façade forming at least part of the exterior of the structure comprising a plurality of façade panels; and an intermediate support structure formed from a plurality of support members which extend between the floor and the façade panels, the support members being formed separately from the at least one floor and connected thereto and the structure further comprising one or more attachments suitable for a vehicle parking structure, the one or more attachment comprising at least one of wheel stops and/or crash barriers secured to and extending upwardly from the support structure.

18. A fixed vehicle parking structure as defined in claim 17, wherein the support members project beyond an end of the at least one floor so as to extend the perimeter of the parking structure beyond the floor.

* * * * *